US010290967B2

(12) United States Patent
Morral Marti et al.

(10) Patent No.: US 10,290,967 B2
(45) Date of Patent: May 14, 2019

(54) DEVICE CONNECTORS

(71) Applicant: Hewlett-Packard Development Company, L.P., Houston, TX (US)

(72) Inventors: Pol Morral Marti, Sant Cugat del Valles (ES); Jorge Martin Montserrat, Sant Cugat del Valles (ES); Pau Martin Vidal, Barcelona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/757,303

(22) PCT Filed: Nov. 17, 2015

(86) PCT No.: PCT/US2015/061040

§ 371 (c)(1),
(2) Date: Mar. 2, 2018

(87) PCT Pub. No.: WO2017/086930

PCT Pub. Date: May 26, 2017

(65) Prior Publication Data

US 2018/0248295 A1 Aug. 30, 2018

(51) Int. Cl.
*H01R 13/64* (2006.01)
*H01R 13/453* (2006.01)
(Continued)

(52) U.S. Cl.
CPC ..... *H01R 13/4534* (2013.01); *H01R 13/629* (2013.01); *H01R 13/631* (2013.01)

(58) Field of Classification Search
CPC ..... H01R 13/6315; H01R 13/631; H01R 23/7005
(Continued)

(56) References Cited

U.S. PATENT DOCUMENTS 5,080,604 A * 1/1992 Rider ..... H01R 13/631 439/357
5,356,300 A * 10/1994 Costello ..... H01R 13/631 439/101
(Continued)

FOREIGN PATENT DOCUMENTS

JP 2003315624 11/2003
JP 2007134227 5/2007

OTHER PUBLICATIONS

International Search Report and Written Opinion for International Application No. PCT/US2015/061040 dated Aug. 12, 2016, 10 pages.
(Continued)

*Primary Examiner* — Phuong Chi T Nguyen
(74) *Attorney, Agent, or Firm* — HP Inc. Patent Department

(57) ABSTRACT

In an example, a device connector may comprise a male connector plate, comprising a first connector to communicatively engage with a second, complementary connector disposed on a female connector plate, a guide post for insertion into a complementary guide slot on the female connector plate, and a dust cover actuation post to engage with a dust cover actuation tab on the female connector plate. A dust cover disposed on the female connector plate may uncover the second connector upon the engagement of the dust cover actuation post with the dust cover actuation tab, such that the first connector may communicatively engage with the second connector.

11 Claims, 5 Drawing Sheets

(51) Int. Cl.
*H01R 13/629* (2006.01)
*H01R 13/631* (2006.01)

(58) Field of Classification Search
USPC ..... 439/248, 247, 378
See application file for complete search history.

(56) References Cited

U.S. PATENT DOCUMENTS

| | | | | |
|---|---|---|---|---|
| 5,385,481 | A * | 1/1995 | Kotyuk | H01R 13/6315 439/248 |
| 5,401,183 | A | 3/1995 | Tan et al. | |
| 5,716,224 | A | 2/1998 | Masuda et al. | |
| 5,762,513 | A * | 6/1998 | Stine | H01R 13/6273 439/358 |
| 6,371,657 | B1 | 4/2002 | Chen et al. | |
| 6,908,330 | B2 * | 6/2005 | Garrett | H01R 13/518 439/378 |
| 7,883,344 | B1 | 2/2011 | Felton et al. | |
| 8,185,229 | B2 | 5/2012 | Davidson | |
| 8,944,841 | B2 * | 2/2015 | YuQiang | H01R 13/64 439/378 |
| 9,099,811 | B2 | 8/2015 | Simmel et al. | |
| 2003/0081913 | A1 | 5/2003 | Zhu et al. | |
| 2004/0029427 | A1 * | 2/2004 | Shimada | H01R 13/22 439/247 |
| 2014/0334779 | A1 | 11/2014 | Megason et al. | |

OTHER PUBLICATIONS

"The Myth of "Safety Socket Covers"—unnecessary and a hazard", 3 pages http://www.fatallyflawed.org/uk/.

* cited by examiner

DEVICE CONNECTORS

BACKGROUND

Electro-mechanical system, such as printing systems, may have components that engage with one another through mechanical connectors. The mechanical connectors may be conduits for, or enable the transmission of signals from one component of the system to another. Mechanical connectors may need to be properly aligned with each other in order to correctly mechanically engage, such that the transmission of signals can occur.

DETAILED DESCRIPTION

Figure 1A:
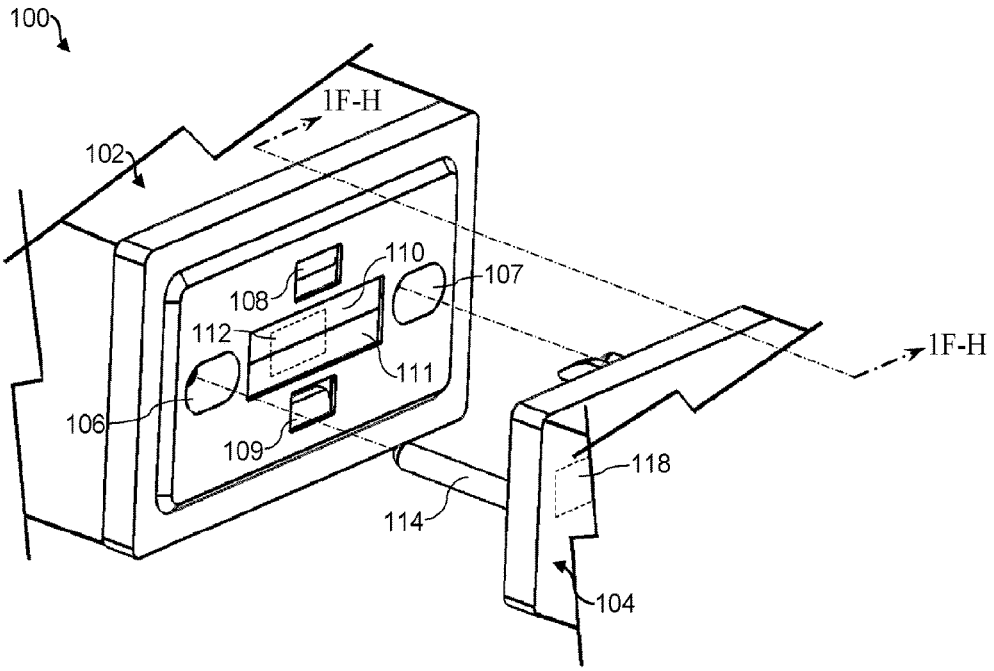
FIG. 1A is a perspective view of an example device connector.
Figure 1B:
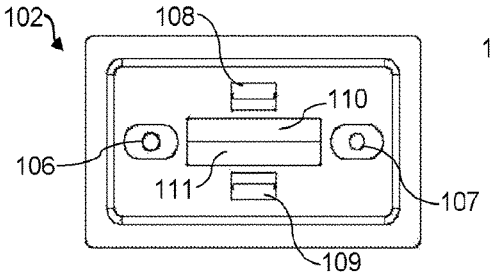
FIG. 1B is a front view of an example female connector plate of an example device connector.
Figure 1C:
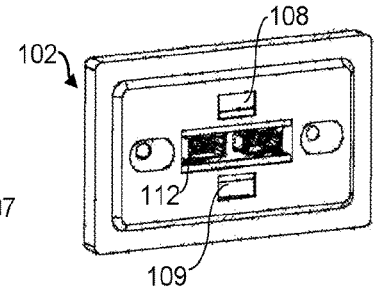
FIG. 1C is a perspective view of an example female connector plate of an example device connector.
Figure 1D:
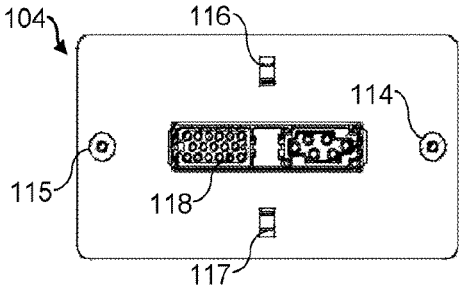
FIG. 1D is a front view of an example male connector plate of an example device connector.
Figure 1E:
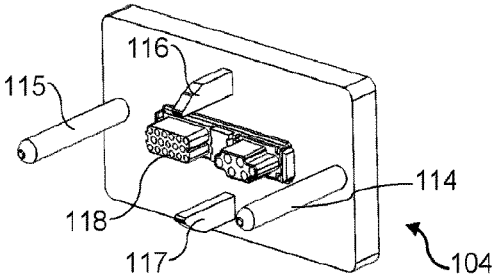
FIG. 1E is a perspective view of an example male connector plate of an example device connector.

Printing systems or other electro-mechanical systems may have components at engage with one another through mechanical connectors. The mechanical connectors may be conduits for, or enable the transmission of signals from one component of the system to another. Such signals may include electrical signals, optical signals, or other types of data transmission signals. Mechanical connectors arty need to be properly aligned with each other in order to correctly mechanically engage such that the transmission of signals can occur.

In some situations, the mechanical connectors may be engaged through a blind-mate connection. Blind-mite connections may refer to the engagement or inning of mechanical connectors without any visual or tactile indications of the proper alignment of the connectors, or without the ability for a user to mutually align the connectors. In some electro-mechanical systems, movable components may be inserted into receiving systems, bays, cavities, racks, or trays at an improper angle for alignment of the component's connector with the intended mating connector, because of the blind-mate nature of the connection. Therefore, in such a situation, the mechanical connector of the inserted component may be slightly or very misaligned with the intended mating connector of the receiving component or system, thereby causing an interference between the connectors, or preventing the proper mating of the connectors fir the transmission of signals.

Additionally, in some situations, the electro-mechanical system may be located or disposed in an environment containing contaminants, airborne particulates, or other dust, particles, or material that could be detrimental to the performance of the signal transmission through the mechanical connectors. Such an environment may be an area near or within a three-dimensional (3D) printer, a selective laser sintering (SLS) 3D printer, or another type of powder-based 3D printer. Areas in or near 3D printers may have dusty or powdered print media floating through the air or resting on various surfaces that could detrimentally affect the signal transmission through a mechanical connector. For example, the area near or around a 3D printing powder bed may be especially susceptible to such floating particulate, and mechanical connectors in such an area could experience detrimental effects due to floating particulate.

In some situations, it may be desirable to have a 3D printing system with a removable device or component having a mechanical connector. The removable device or component may have an electrical, optical, or other signal communication with the 3D printer or a part thereof, and accomplish this communication through the mechanical connector. Engaging the mechanical connector on the removable component with an intended mating connector on the printer may be through a blind-note nature, wherein a user or other motive force inserting the removable component into the printer may be unable to determine if the mechanical connector and its intended mate are properly aligned. Further, it may be desirable to have such a mechanical blind-mate connector disposed near a part of the 3D printer that can be especially dusty, or have powdered print media floating through the air.

Implementations of the present disclosure provide a mechanical device connector that is capable of enabling the transmission of data signals. The device connector may have a feature to ensure the proper alignment of one half of the connector with its mate in a blind-mate connection. Further, the mechanical connector may be able to protect the signal transmission components or connectors disposed within the device connector horn floating dust or other particulate in the air when the connector halves are disengaged. This dust protection may thereby prevent the impairment of the signal transmission through the device connector when the connector halves are re-engaged with each other.

Referring no to FIG. 1A, a perspective view of an example device connector 100 is illustrated. The device connector 100 may, in some implementations, be a mechanical connector to enable the transmission of signals between a removable portion of a 3D printer, and a stationary portion of the printer. In further implementations, the device connector 100 may enable the transmission of signals between a removable cart having a bed of powdered 3D print media and a receiving rack or bay for the cart within a stationary portion of a 3D printer. In other implementations, the device connector 100 may enable the transmission of signals between two components of another type of system that may be exposed to potentially harmful floating particulate and/or may need to transmit signals through a blind-mate connection.

In some implementations, the device connector 100 may include a female connector plate 102 and a male connector plate 104 to mechanically mate with the female connector plate 102. The male connector plate may comprise a first connector 118 to communicatively mate or engage with a second connector 112 of the female connector plate so that the transmission of electrical, optical, or other data signals may occur between the first and second connectors 118 and 112. The first and second connectors 118 and 112 may each comprise one or a plurality of complementary mating individual connectors, in some implementations. In further implementations, the first and second connectors 118 and 112 may be complementary electrical connectors. Referring additionally to FIGS. 1B-E, a front and perspective view of an example female connector plate 102 as well as an example male connector plate 104 are illustrated.

The female connector plate 102, in addition to the second connector 112, may also comprise a guide slot 106, a dust cover 110, and a dust cover actuation tab 108. The guide slot 106 may be a cavity within the female connector plate 102 to insertably receive a complementary guide post 114 disposed on the mating mile connector plate 104. In some implementations, the female connector plate 102 may comprise just a single guide slot to receive as complementary single guide post. In further if implementations, the female connector plate 102 may comprise multiple guide slots, or a first and second guide slot 106 and 107, respectively, to receive as matching number of guide posts, for example 114 and 115, respectively, on the male connector plate 104. In yet further implementations, the female connector plate 102 may comprise a plurality or more than two guide slots to receive a matching number or guide posts. Each of the guide slots may have a similar structure or geometry and each may receive a separate guide post. The guide slots 106 and 107 may include a tapered portion at the front or entrance of the guide slots 106 and 107, and then transition to a tighter diameter or width having a closer tolerance to the diameter or width of the intended mating guide posts 114 and 115. Thus, in a blind-mate situation, if the female connector plate 102 and the male connector plate 104 are misaligned when approaching a mating position, as long as each guide post 114 and 115 is inserted into the tapered portion of the respective guide slots 106 and 107, the connector plates will be forced to adjust their alignment to each other such that the guide posts can be fully inserted into the tighter width section of each guide slot. The tighter width section of each slot 106 and 107 is to closely match the diameter or width of the respective mating guide post 114 and 115 so that the first and second connectors 118 and 112 can properly align and mate and signal transmission between the two can occur. In some implementations, the guide slots 106 and 107 may be disposed laterally, or to the side, from the portion of the female connector plate 102 having the second connector 112. In further implementations, there may be a guide slot 106 and 107 disposed on either lateral side of the female connector plate 102, adjacent to the second connector 112. In other implementations, the guide slots 106 and 107 may be disposed in other locations on the female connector plate 102. Accordingly, the orientation or location of the guide posts 114 and 115 on the male connector plate 104 may match, or be a mirror image of, the orientation or location of the guide slots 106 and 107, respectively, on the female connector plate 102. Additionally, to aid in aligning the female and male connector plates 102 and 104 for mating or engagement, one or both of the connector plates may include bias or spring members. The bias or spring members may enable the respective female or male connector plates 102 and 104 to float in one, two, or all three Cartesian geometric dimensions relative to the other connector plate. This ability to float may additionally help the guide posts 114 and 115 to engage with and insert into the guide slots 106 and 107.

The female connector plate 102 may further comprise a dust cover 110. The dust cover may be a rigid or semi-rigid plate or shield to cover the second connector 112 of the female connector plate 102. The dust cover 110 may slidably cover the second connector 112, or cover the connector 112 in another manner, such as in a rotatable fashion. The dust cover 110 may be resilient enough and sized to a sufficient degree so as to prevent particulate or dust floating in the air near the female connector plate 102 from penetrating or floating around the dust cover 110 and coating or resting on or in the second connector 112. In some implementations, the dust cover 110 may include multiple portions, such as a first dust cover portion 110 and a second dust cover portion 111 to each slidably cover a portion of the second connector 112. In some implementations, the first dust cover portion 110 may slidably cover a top portion of the second connector 112, while the second dust cover portion 111 may slidably cover a bottom portion of the second connector 112. In further implementations, the first and second dust cover portions 110 and 111 may meet and engage each other in front of the second connector 112 such that the second connector 112 will not be exposed to any dust or other airborne particulate.

The female connector plate 102 may also comprise a dust cover actuation tab 108. The dust cover actuation tab may engage with a dust cover actuation post 116 disposed on the male connector plate 104. The dust cover actuation tab 108 may be disposed within an aperture in the female connector plate 102 that is sized sufficiently to receive the dust cover actuation post 116. Further, the dust cover actuation tab 108 may be operably engaged with the dust cover 110 such that the dust cover 110 moves in association with movement of the dust cover actuation tab 108. In other words, if the dust cover actuation tab 108 were to be slid in an upward direction, for example, the dust cover 110 would also slide in an upward direction a corresponding distance. Thus, the dust cover actuation post 116 may, upon entering the aperture having the dust cover actuation tab 108, engage with the actuation tab 108 so that the tab 108 slides in a lateral direction relative to the insertion direction of the dust cover actuation post 116. The dust cover 110 may, therefore, also slide in the lateral direction, uncovering the second connector 112.

The female connector plate 102, in implementations having a first and second dust cover portion 110 and 111, may also include a second dust cover actuation tab 109, which may be disposed in a second, or separate aperture in the female connector plate 102 from the dust cover actuation tab 108. In some implementations, the first and second dust cover actuation tabs 108 and 109 may be disposed in separate apertures flout the first and second guide slots. In such an implementation, the dust cover actuation tab 108 may be referred to as a first dust cover actuation tab 108. Further, in such an implementation, the dust cover actuation post 116 disposed on the male connector plate 104 may be referred to as a first dust cover actuation post 116, and may engage with the first dust cover actuation tab 108. Additionally, in such an implementation, the male connector plate 104 may also comprise a second dust cover actuation post 117 to engage with the second dust cover actuation tab 109. The first dust cover actuation tab 108 may be operably engaged with the first dust cover portion 110, while the second dust cover actuation tab 109 may be operably engaged with the second dust cover portion 111. Thus, the first dust cover actuation post 116 may, upon entering the aperture having the first dust cover actuation tab 108, engage with or contact the first actuation tab 108 so that the first actuation tab 108 slides in a lateral direction relative to the insertion direction of the first dust cover actuation post 116. The first dust cover portion 110 may, therefore, also slide in the lateral direction partially uncovering the second connector 112. Similarly, the second dust cover actuation post 117 may, upon entering the separate or second aperture having the second dust cover actuation tab 109, engage with or contact the second actuation tab 109 so that the second actuation tab 109 slides in a lateral direction relative to the insertion direction of the second dust cover actuation post 117. The second dust cover portion 111 may, therefore, also slide in the lateral direction, partially uncovering the second connector 112. The partial uncovering of the second connector 112 by each of the first and second dust cover portions 110 and 111 may, together, completely uncover the second connector 112 so that it may operably mate with the first connector 118 of the male connector plate 104. In further implementations, each of the first and second dust cover portions 110 and 111 may slide in lateral directions that are opposite from one another in order to completely uncover the second connector 112.

Figure 1F:
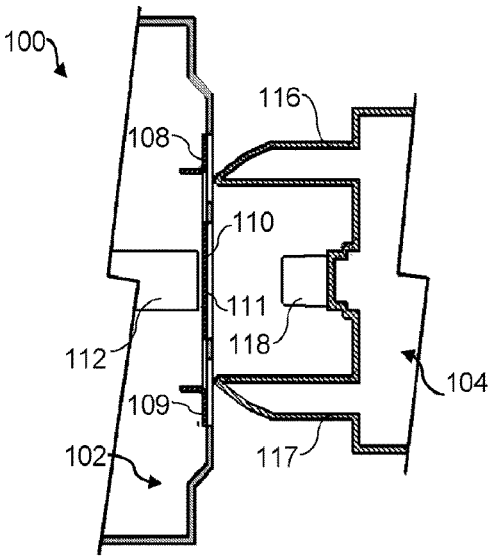
FIG. 1F is a cross-sectional view of an example device connector.
Figure 1G:
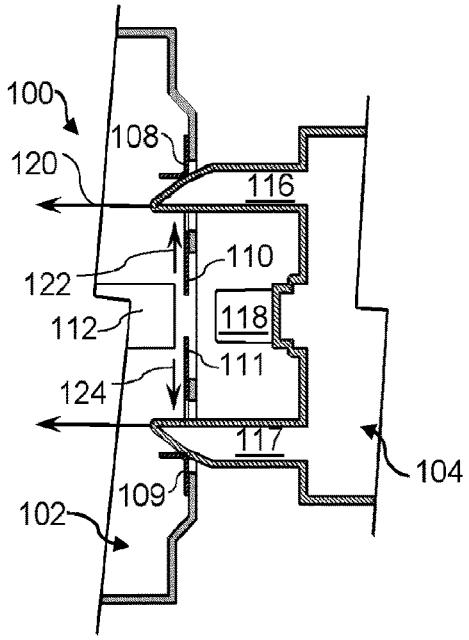
FIG. 1G is a cross-sectional view of an example device connector.
Figure 1H:
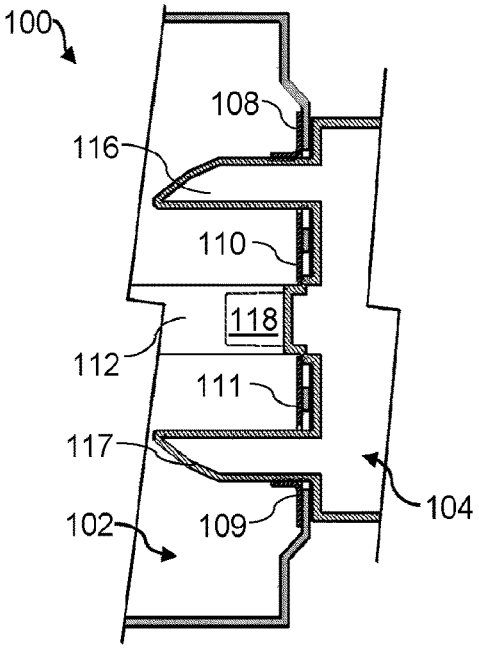
FIG. 1H is a cross-sectional view of an example device connector.
Figure 2A:
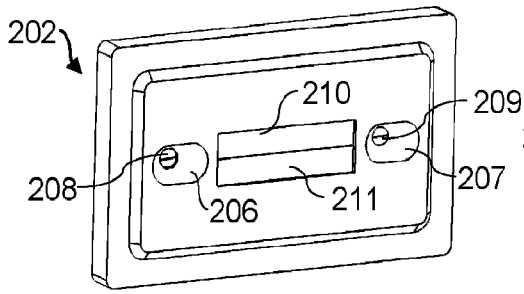
FIG. 2A is a perspective view of an example female connector plate of an example device connector.
Figure 2B:
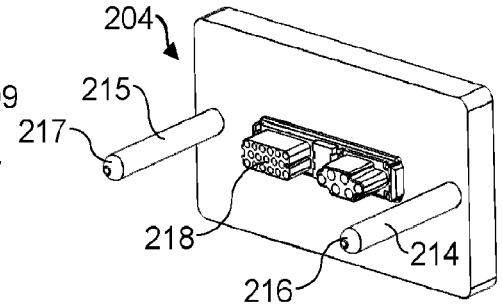
FIG. 2B is a perspective view of an example male connector plate of an example device connector.

Referring now to FIGS. 1F-H, cross-sectional side views of an example device connector 100 are illustrated at different stages of mating. FIGS. 1F-H illustrate an example device connector having a female connector plate 102 and a male connector plate 104. The male connector plate 104 may comprise first connector 118, and a first and second dust cover actuation post 116 and 117, respectively, as they are described above. The female connector plate 102 may comprise a second connector 112 far operable engagement with the first connector 118 for the transmission of data signals, as well as a first and second dust cover actuation tab 108 and 109, for engagement with the first and second dust cover actuation posts 116 and 117 of the male connector plate 104. Each of the first and second dust cover actuation tabs 108 and 109 may be disposed within a separate aperture on the female connector plate 102, and may be operably connected to or engaged with a first dust cover portion 110, and a second dust cover portion 111, respectively. The first and second dust cover portions 110 and 111 may each slidably cover a portion of the second connector 112, and engage with or meet each other in front of the second connector 112 to completely cover the connector 112, as illustrated in FIG. 1F.

FIG. 1F illustrates the example device connector 100 having the female connector plate 102 and the male connector plate 104 aligned for mating, yet having the dust cover actuation posts 116 and 117, and the first connector 118 completely disengaged from the respective dust cover actuation tabs 108 and 109, and second connector 112 of the female connector plate 102. As such, the first and second dust cover portions 110 and 111 are completely covering the second connector 112 in a closed position such that no environmental particulate or dust can rest on or cover part or all of the second connector 112. In the orientation depicted by FIG. 1F, the guide posts (not shown) of the male connector plate 104, may be engaged with the complementary guide slots (not shown) of the female connector plate 102, in some implementations. As such, the female connector plate 102 and the male connector plate 104, and thus the first and second connectors 118 and 112, may be properly aligned for full engagement with each other.

FIG. 1G illustrates the example device connector 100 having the female connector plate 102 partially engaged with the male connector plate 104. The female and male connector plates 102 and 104 have translated or moved towards each other along an example direction 120. The first and second dust cover actuation posts 116 and 117 have come into contact with and at least partially engaged with the first and second dust cover actuation tabs 108 and 109, respectively. As such, the geometry of the first dust cover actuation post 116 has caused the first dust cover actuation tab 108 to slide or translate along a lateral or substantially orthogonal direction 122 to direction 120. Due to the operable engagement or connection between the first dust cover actuation tab 108 and the first dust cover portion 110, the first dust cover portion 110 has also slid or translated in the lateral direction 122, partially uncovering the second connector 112. Similarly, the geometry of the second dust cover actuation post 117 has caused the second dust cover actuation tab 109 to slide or translate along a similar lateral of substantially orthogonal direction 124 to direction 120. In some implementations, the directions 122 and 124 may be outward from each other or substantially opposite to each other. As such, due to the operable engagement or connection between the second dust cover actuation tab 109 and the second dust cover portion 111, the second dust cover portion 111 has also slid or translated in the lateral direction 124, also partially uncovering the second connector 112. The first and second dust cover portions 110 and 111 have not been fully slid from the closed position in front of the second connector 112, and thus the second connector 112 is not yet fully uncovered in an open position. Therefore, the first and second connectors 118 and 112 are not engaged with each other at this stage.

FIG. 1H illustrates the example device connector 100 with the female connector plate 102 fully engaged with and mated to the male connector plate 104. Correspondingly, the first and second connectors 114 and 112 are frilly communicatively mated together such that the transmission of signals between the two can occur. Thus, the dust cover actuation posts 116 and 117 are fully engaged with the respective dust cover actuation tabs 108 and 109 such that the first and second dust cover portions 110 and 111 have completed sliding; or translating along lateral directions 122 and 124, respectively, to frilly slidably uncover the second connector 112 in an open position so that the first connector 118 can communicatively engage with the second connector 112.

Referring now to 2A-B, perspective views of an example female connector plate 202 and an example male connector plate 204 of an example device connector are illustrated. Example female connector plate 202 and mile connector plate 204 may be similar to example female connector plate 102 and mile connector plate 104, respectively. Further, the similarly named elements of example female and male connector plates 202 and 204 tray be similar in function and/or structure to the elements of example female and male connector plates 102 and 104, as they are described above. The female connector plate 202 may comprise a first and second guide slot 206 and 207 to receiver a first and second guide post 214 and 215 disposed on the talk connector plate 204. Further, the female connector plate 202 may comprise a first and second dust cover actuation tab 208 and 209. The first and second dust cover actuation tabs 208 and 209 may engage with a first and second dust cover actuation post 216 and 217, respectively, disposed on the male connector plate 204. The first dust cover actuation tab 208 may be operably engaged with a first dust cover portion 210, and the second dust cover actuation tab 209 may be operably engaged with a second dust cover portion 211, such that, upon engagement of the first and second actuation tabs 208 and 209 with the respective actuation posts 216 and 217, the first and second dust cover portions are to each partially slidably uncover the second connector.

In some implementations, the first and second dust cover actuation tabs 208 and 209 may be disposed within the first and second guide slots 206 and 207, respectively, instead of within separate apertures. Accordingly, the first and second dust cover actuation posts 216 and 217 may be disposed on the first and second guide posts 214 and 215, respectively, instead of on separate protrusions. In other words, each of the first and second guide posts 214 and 215 may include geometry or structure that may be similar to the geometry or structure of the first and second dust cover actuation posts 216 and 217. Such geometry may be disposed on a front portion or tip of each of the guide posts 214 and 215, in some implementations. As such, upon the engagement of the first and second guide posts 214 and 215 with the respective guide slots 206 and 207, the first and second dust cover actuation posts 216 and 217 may also engage with the respective first and second dust cover actuation tabs 20$ and 209. Therefore, upon full engagement of the guide posts 214 and 215 with the pride slots 206 and 207, the first and second dust cover portions 210 and 211 may fully slidably uncover the second connector of the female connector pate 202.

Figure 3A:
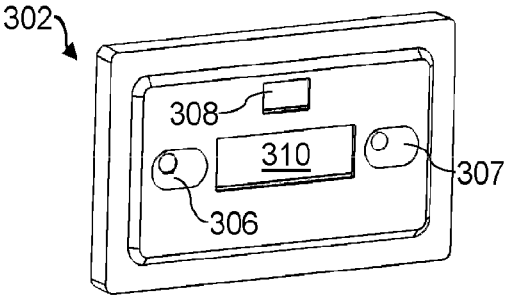
FIG. 3A is a perspective view of an example female connector plate of an example device connector.
Figure 3B:
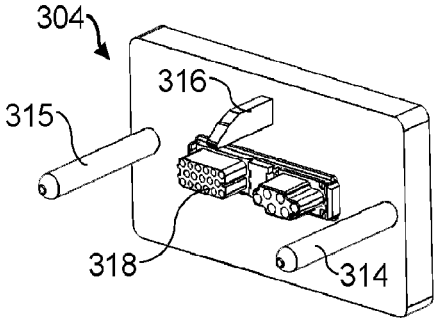
FIG. 3B is a perspective view of an example male connector plate of example device connector.

Referring now FIGS. 3A-B, perspective views of an example female connector plate 302 and an example male connector plate 304 of an example device connector are illustrated. Example female connector plate 302 and male connector plate 304 may be similar to example female connector plate 102 and 202, and male connector plate 104 and 204, respectively. Further, the similarly named elements of example female and male connector plates 302 and 304 may be similar in function and/or structure to the elements of example female and male connector plates 102 and 202, and 104 and 204, as they are described above. In some implementations, the female connector plate 302 may include a single dust cover actuation tab 308, which may be disposed in a separate aperture on the female connector plate 302 from the guide slots 306 and 307. The dust cover actuation tab 308 may be to receive and engage with a complementary dust cover actuation post 316 on the male connector plate 304. Further, the dust cover actuation tab 308 may be operably engaged with a dust cover 310 that slidably covers the entire front face of a second connector of the female connector plate 302, so that the dust cover 310 moves and slides correspondingly to movement of the actuation tab 308. The dust cover actuation post 316 may be a separate post or protrusion from the guide posts 314 and 315, and may include geometry or a profile such that, upon engaging with the actuation tab 308, the actuation post 316 slides the actuation tab 308, and thus the entire dust cover 310, in a lateral direction until the dust cover 310 completely uncovers the second connector of the female connector plate 302.

Figure 4A:
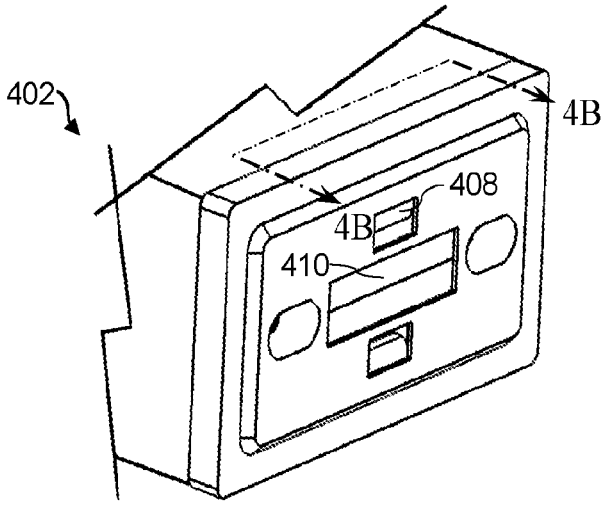
FIG. 4A is a perspective view of an example female connect plate of an example device connector.
Figure 4B:
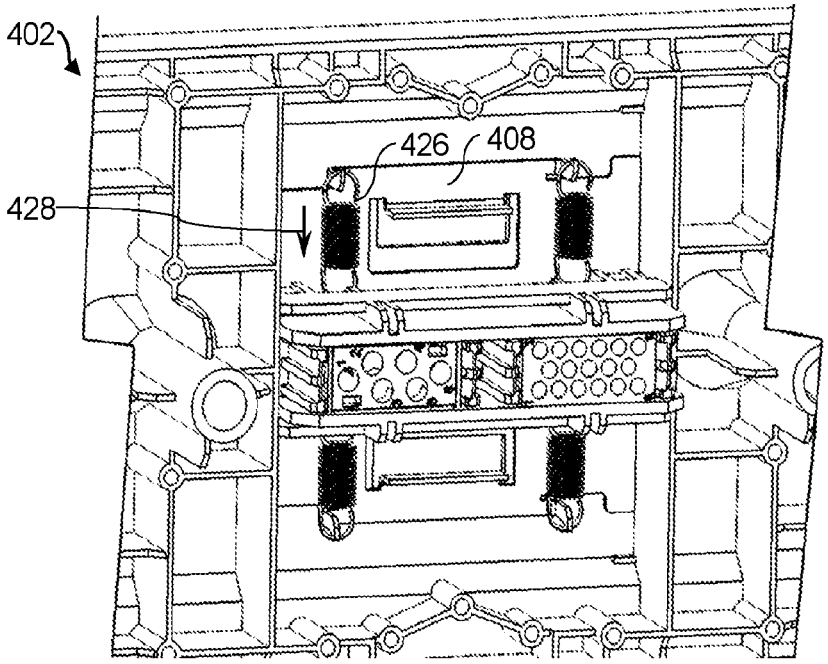
FIG. 4B is a perspective view of an example female connector plate of an example device connector.

Referring now to FIGS. 4A-B, perspective views of an example female connector plate 402 of an example device connector are illustrated. Example female connector plate 402 may be similar to example female connector plates 102, 202, and 302. Further, the similarly named elements of example female connector plate 402 may be similar in function and/or structure to the elements of example female connector plates 102, 202, and 302, as they are described above. The female connector plate 402 may comprise a bias member 426. The bias member may be a resilient member such as a spring, or, in some implementations, an extension spring. The bias member 426 may be engaged with a dust cover actuation tab 408 of the female connector plate 402, such that the bias member extends and exerts a return force upon the dust cover actuation tab 408 upon the actuation tab 408 sliding in a lateral direction, as described above. The dust cover actuation tab 408 may be operably engaged with a dust cover 410, such that the dust cover 410 moves in accordance with movement of the actuation tab 408. In other words, upon movement of the actuation tab 408, the dust cover 410 may move in a similar direction. The return force, in some implementations, may be in a return direction 428, substantially opposite to the direction of lateral movement of the dust cover actuation tab 408 and the dust cover 410. Thus, the bias member 426 may exert the return three in the return direction such that the actuation tab 408 and the dust cover 410 return to a starting or closed position upon a dust cover actuation post being extracted from engagement with the actuation tab 408. In further implementations, the female connector plate 402 may include a plurality of bias members 426 engaged with the dust cover actuation tab 408. In yet further implementations, the female connector plate 402 may include a plurality of dust cover actuation tabs, each engaged with a dust cover portion, and one or a plurality of bias members 426.

What is claimed is:

1. A mate connector plate, comprising:

a first connector to communicatively engage with a second complementary connector disposed on a female connector plate;

a guide post 114/115 for insertion into a complementary guide slot on the female connector plate; and a dust cover actuation post to engage with a dust cover actuation tab on the female connector plate, wherein a dust cover disposed on the female connector plate is to uncover the second connector upon the engagement of the dust cover actuation post with the dust cover actuation tab, such that the first connector may communicatively engage with the second connector;

a first dust cover actuation post to engage with a first dust cover actuation tab on the female connector plate, and a second dust cover actuation post to engage with a second dust cover actuation tab on the female connector; wherein the first and second actuation tabs are to, together, uncover for second connector of the dust cover upon die engagement of each dust cover actuation post with the respective dust cover actuation tab, such that the first connector may communicatively engage with the second connector;

a first guide post for insertion into a first complementary guide slot on the female connector plate, and a second guide post for insertion into a second complementary guide slot on foe female connector plate, wherein foe first and second guide posts are to align foe male connector plate with foe female connector plate upon for guide posts insertion into the respective guide slots such that for first and second connectors can communicatively engage.

2. The mate connector plate of claim 1, wherein the first and second guide posts further comprise the fat and second dust cover actuation posts, respectively, wherein the first, and second dust cover actuation posts are to engage with tine fat and second dust cover actuation tabs, disposed within the fat and second complementary guide slots, respectively.

3. The mate connector plate of claim 1, wherein the fat and second guide posts are separate protrusions from the first and second dust cover actuation posts, and the fat and second dust cover actuation tabs are each disposed within a separate aperture on the female connector plate from the first, and second snide slots.

4. A female connector plate, comprising:

a second connector to communicatively engage with a first connector disposed on a male connector plate;

a guide sbt to receive a guide post disposed on the mate connector plate;

a dust cover to cover the second connector; and a dust cover actuation tab to engage with a dust cover actuation post disposed on the male connector plate, wherein the dust cover is to uncover the second connector upon the engagement of the dust cover actuation tab with the dust cover actuation post, such that the first connector may communicatively engage with the second connector;

a first dust cover actuation, tab to engage with a first dust cover actuation post on the male connector plate, and a second dust cover actuation tab to engage with a second dust cover actuation post on the male connector plate, wherein the first dust cover actuation tab is operably engaged with a first dust co ver portion, and the second dust cover actuation tab is operably engaged with a second dust cover portion, such that, upon, engagement of the first and second actuation tabs with the respective actuation posts, the fat and second dust cover portions are to each partially uncover die second connector.

5. The female connector plate of claim 4, further comprising multiple guide slots, each to receive a separate guide post disposed on the male connector plate.

6. The female connector plate of claim 5, wherein the first and second dnst cover actuation tabs are each disposed within a separate guide slot, and wherein the first and second dust cover actuation posts are each disposed on a separate guide post.

7. The female connector plate of claim 5, wherein the first and second dust cover actuation tabs are each disposed within a separate aperture on the female connector plate from the guide slots, and wherein the posts are separate protrusions from the first and second dust cover actuation posts on the male connector plate.

8. An device connector, comprising:

a male connector plate, including: a first connector; a plurality of guide posts; and a dust cover actuation post; and a female connector plate to mate with the male connector plate, including;

a second connector to communicatively engage with the first connector; a dust cover to cover the second connector; a plurality of guide slots to receive tire plurality of guide posts; and a dust cover actuation tab disposed within an aperture in the female connector plate, wherein die dust cover actuation tab is operably engaged with the dust cover such that the dust cover moves in association with movement of the dust cover actuation tab, wherein die dust cover actuation tab is to engage with the dust cover actuation post upon the insertion of the post into the aperture comprising the actuation tab, such that the post is to move the tab, and thereby the dust cover, in a lateral direction so as to uncover the second connector so that it may communicatively engage with the first connector;

wherein the dust cover of the female connector plate includes a first dust cover portion and a second dust cover portion, wherein the first dust cover portion & operably engaged with a first dust cover actuation tab, and the second dust cover portion is operably engaged with a second dust cover actuation tab disposed within a separate aperture to receive a separate dust cover actuation post of the male connector plate.

9. The device connector of claim 8, wherein the first and second dust cover actuation tabs are to engage with the dust cover actuation posts upon the insertion of the posts into the apertures comprising the actuation tabs, such that each post is to move the respective tab, and thereby the respective dust cover portion, hi a lateral direction so as to uncover the second connector so that it may communicatively engage with the first connector.

10. The device connector of claim 9, wherein the female connector plate further comprises a bias member operably engaged with the first and second dust cover portions, wherein upon extraction of the dust cover actuation posts from engagement with the actuation tabs, the bias member is to return the first and second dust cover portions to a closed position covering the second connector.

11. The device connector of claim 8, wherein one or both of the male connector plate and the female connector plate can float m three dimensions relative to the other connector plate such that the plurality of guide slots of the female connector plate can receive the plurality of guide posts of the male connector plate.

* * * * *